US010600591B2

(12) United States Patent
Chiang et al.

(10) Patent No.: US 10,600,591 B2
(45) Date of Patent: Mar. 24, 2020

(54) LUMINOUS KEYBOARD HAVING TRANSLUCENT LIGHT DIFFUSING RUBBER DOMES

(71) Applicant: Primax Electronics Ltd., Taipei (TW)

(72) Inventors: Ying-Te Chiang, Taipei (TW); Lei-Lung Tsai, Taipei (TW); Yu-Ming Lin, Taipei (TW); Ding-Hsiang Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/189,053

(22) Filed: Nov. 13, 2018

(65) Prior Publication Data

US 2019/0172662 A1 Jun. 6, 2019

(30) Foreign Application Priority Data

Dec. 1, 2017 (TW) ..... 106142214 A

(51) Int. Cl.
*H01H 13/83* (2006.01)
*H01H 13/705* (2006.01)

(52) U.S. Cl.
CPC ..... *H01H 13/83* (2013.01); *H01H 13/705* (2013.01); *H01H 2215/004* (2013.01); *H01H 2219/056* (2013.01); *H01H 2219/06* (2013.01); *H01H 2219/062* (2013.01)

(58) Field of Classification Search
CPC ..... H01H 13/70; H01H 13/83; H01H 3/12; H01H 9/182; H01H 2009/187; H01H 2219/054; H01H 2219/056; H01H 2219/062; H01H 2219/06; H01H 2219/0622
See application file for complete search history.

(56) References Cited

U.S. PATENT DOCUMENTS 5,225,818 A * 7/1993 Lee ..... H01H 13/7006 200/313
5,280,145 A * 1/1994 Mosier ..... H01H 13/7006 200/313
6,148,075 A * 11/2000 Inubushi ..... G09F 13/04 379/368
6,590,174 B2 * 7/2003 Zysnarski ..... G05G 1/105 200/310
10,309,589 B2 * 6/2019 Peterson ..... F21K 9/65
2016/0035514 A1 * 2/2016 Kweon ..... H01H 13/83 200/314

* cited by examiner

*Primary Examiner* — Vanessa Girardi
(74) *Attorney, Agent, or Firm* — Kirton McConkie; Evan R. Witt

(57) ABSTRACT

This application provides a luminous keyboard, including a plurality of keys, a plurality of keys, a light guide plate, and a reflector. Each of the keys includes a rubber dome, where the rubber dome is made of a translucent material doped with a plurality of light-diffusion particles, and when the rubber dome is irradiated by a light ray, a part of the light ray is diffused when traveling upward through the rubber dome, and the other part of the light ray is reflected downward by the rubber dome to the reflector, then, is reflected upward, and is diffused when passing by a plurality of light diffusion protrusions of the light guide plate, to be emitted outward through the keys.

6 Claims, 4 Drawing Sheets

LUMINOUS KEYBOARD HAVING TRANSLUCENT LIGHT DIFFUSING RUBBER DOMES

FIELD OF THE INVENTION

This application relates to a luminous keyboard, and particularly, to a luminous keyboard capable of uniformly emitting light on a surface of the keyboard.

BACKGROUND OF THE INVENTION

A keyboard is an indispensable device to modern people for using a computer. A lot of keys are disposed on a keyboard for a user to press to enter an instruction.

With improvement to keyboards, currently, keyboards having backlight modules, which alternatively, are usually referred to as luminous keyboards, have appeared, such keyboards are used in indoor lighting environments (such as offices and rooms), and light rays that travel upward from bottoms of the keyboards to pass through each key can be obviously recognized by human eyes, so as to present visual effects.

However, because light sources disposed on the bottoms of the keyboards emit light rays having a small divergence angle, a place right above a light source would emit light rays and render high brightness, while a periphery distant from a light source render very low brightness because of not being irradiated by light rays. Further, consequently, a plurality of non-uniform bright and dark places would be presented on a surface of an entire keyboard, and vision of a user during operation would be affected, which is not expected by a designer. Therefore, a conventional luminous keyboard still needs to be improved.

SUMMARY OF THE INVENTION

A main objective of the present invention is to provide a luminous keyboard. By changing a material of a rubber dome to a translucent material doped with a plurality of light-diffusion particles, for a light ray emitted to the rubber dome, a part of the light ray is diffused when being transmitted upward through the rubber dome, and the other part of the light ray is reflected and then is diffused by a plurality of light-diffusion protrusions of a light guide plate. Designed proportions of light ray transmission and light ray refection are designed and planned, so as to enable a surface of an entire luminous keyboard to present a uniform light-emitting effect.

According to a preferred implementation concept of this application, a luminous keyboard is provided, including:

a plurality of keys, each of the keys including:

a key cap;

a scissors foot mechanism, located below the key cap and pivotally connected to the key cap; and a rubber dome, disposed below the key cap and pushing the key cap upward, where the rubber dome is made of a translucent material doped with a plurality of light-diffusion particles, and when the rubber dome is irradiated by a light ray, a part of the light ray passes through the rubber dome, and the other part of the light ray is reflected by the rubber dome;

a thin-film circuit board, disposed below the rubber dome, where the rubber dome can receive an external force from the key cap to be deformed downward to trigger the thin-film circuit board to generate an input signal;

a support plate, located below the thin-film circuit board, where the scissors foot mechanism passes through the thin-film circuit board to be pivotally connected to the support plate, and the support plate includes a plurality of light-transmission through holes;

a light guide plate, located below the support plate, where the light guide plate includes an upper surface and a plurality of light-diffusion protrusions formed on the upper surface;

a reflector, located below the light guide plate; and a circuit board assembly, located below the reflector, where the circuit board assembly includes a printed circuit board and a plurality of light sources electrically connected to the printed circuit board, and each of the keys corresponds to at least one of the light source, so that each of the keys receives the light ray emitted from the light source, where after the light ray sequentially passes through the light guide plate, the support plate, and the thin-film circuit board, the part of the light ray passes through the rubber dome and then, is emitted outward through the key cap, and the other part of the light ray is reflected for a first time as being reflected downward by the rubber dome, then is reflected for a second time as being reflected downward by the reflector, is diffused by the light-diffusion protrusions of the light guide plate, and finally, is emitted outward through the key cap.

In a preferred embodiment, the light-diffusion particles are one of polymethylmethacrylate (PMMA) particles, titanium dioxide ($TiO_2$) particles, and toner particles.

In a preferred embodiment, the translucent material has a reflection coefficient and a transmission coefficient, and a value of the reflection coefficient is greater than a value of the transmission coefficient, so that an amount of the reflected light ray is greater than an amount of the transmitted light ray.

In a preferred embodiment, the light-diffusion protrusions surrounds the light sources.

In a preferred embodiment, the key cap includes at least one transparent pattern, and the light ray passes through the at least transparent pattern to illuminate the outside.

In a preferred embodiment, the upper frame covers the thin-film circuit board and exposes the keys.

DETAILED DESCRIPTION OF THE PREFERRED EMBODIMENT

Figure 1:
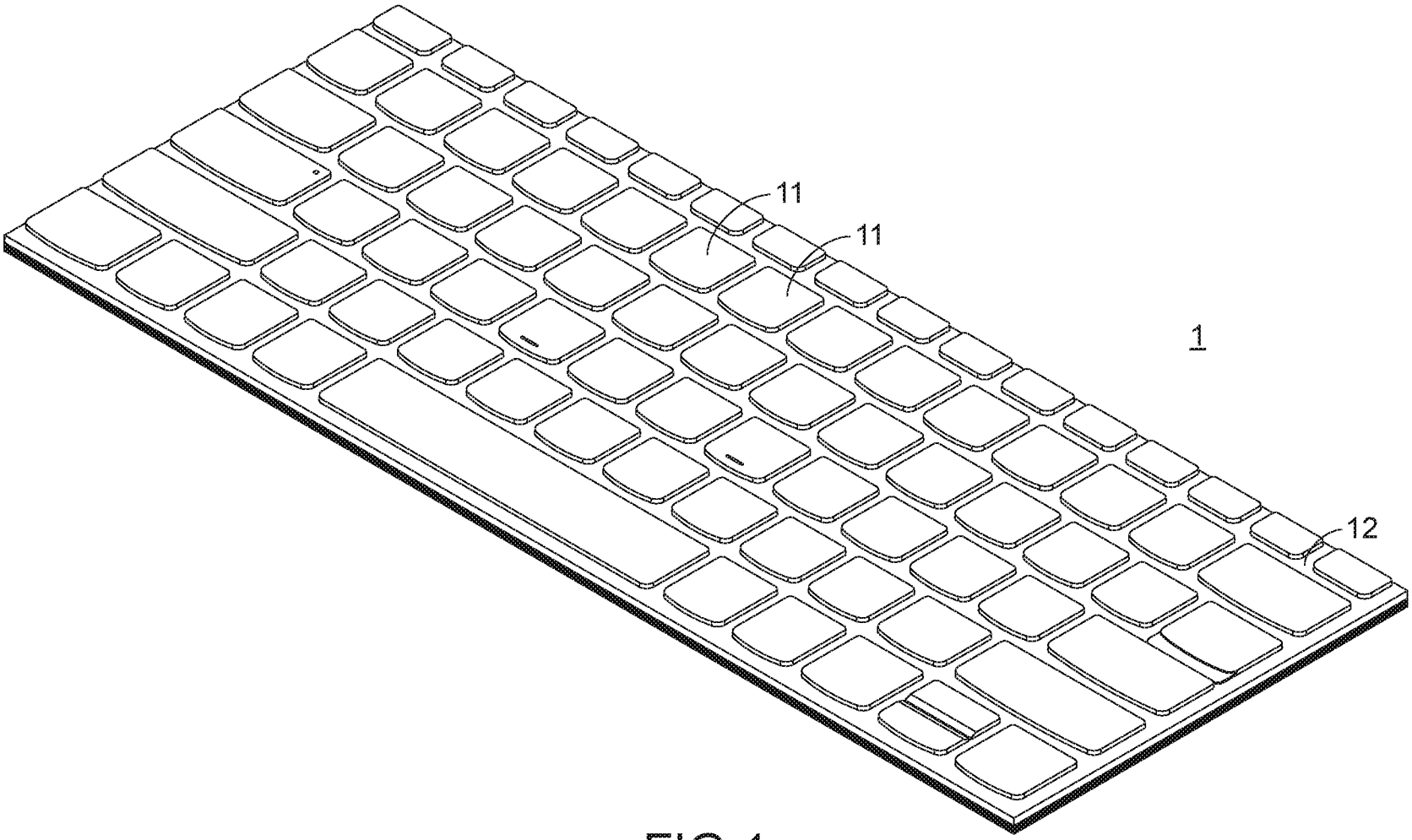
FIG. 1 is a schematic three-dimensional diagram of a luminous keyboard according to this application.
Figure 2:
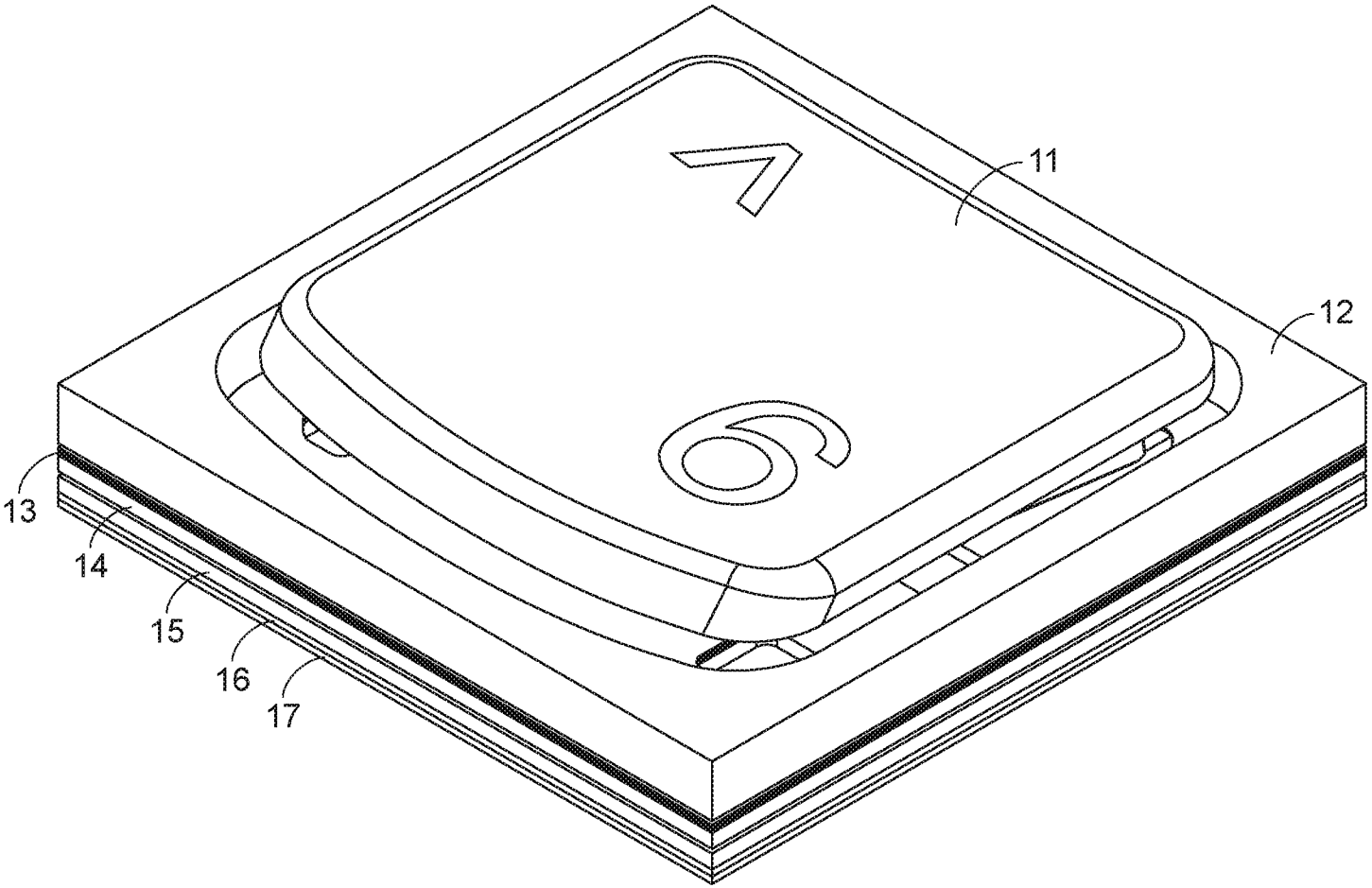
FIG. 2 is a schematic three-dimensional diagram that only shows a single key of a luminous keyboard according to this application.
Figure 3:
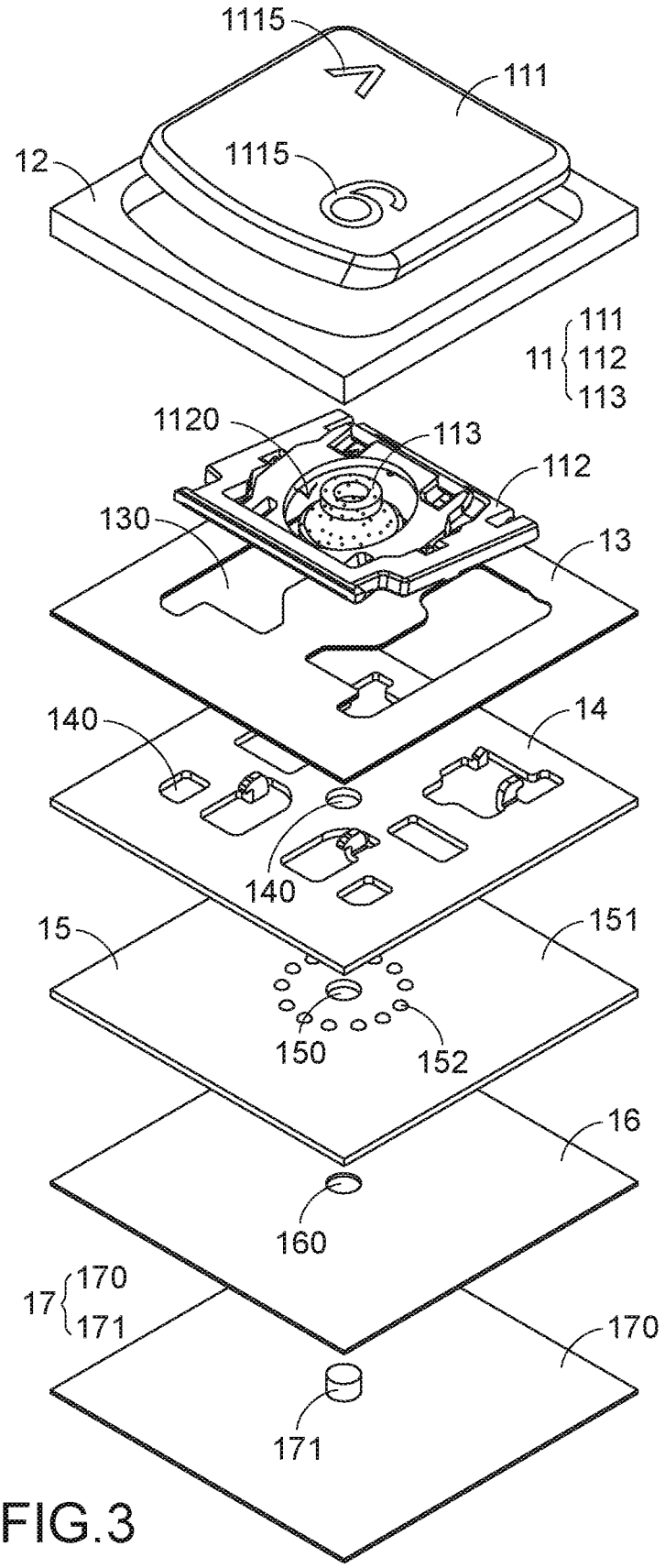
FIG. 3 is an exploded view that only shows a single key of a luminous keyboard according to this application.

FIG. 1 is a schematic three-dimensional diagram of a luminous keyboard according to this application, FIG. 2 is a schematic three-dimensional diagram that only shows a single key of a luminous keyboard according to this application, and FIG. 3 is an exploded view that only shows a single key of a luminous keyboard according to this application. Refer to FIG. 1 to FIG. 3 together. A luminous keyboard of this application includes a plurality of keys 11, a thin-film circuit board 13, a support plate 14, a light guide plate 15, a reflector 16, a circuit board assembly 17, and an upper frame cover 12, and a sequence of relative positions of the foregoing components from top to bottom is the keys 11, the upper frame cover 12, the thin-film circuit board 13, the support plate 14, the light guide plate 15, the reflector 16, and the circuit board assembly 17. The upper frame cover 12 covers the thin-film circuit board 13, the support plate 14, the light guide plate 15, the reflector 16, and the circuit board assembly 17, and only exposes the plurality of keys 11. However, it should be specially noted herein that a person skilled in the art may additionally dispose a housing to cover the foregoing components, or design of the upper frame cover 12 can be omitted. The above are both feasible settings, and no limitation is imposed herein.

Figure 4:
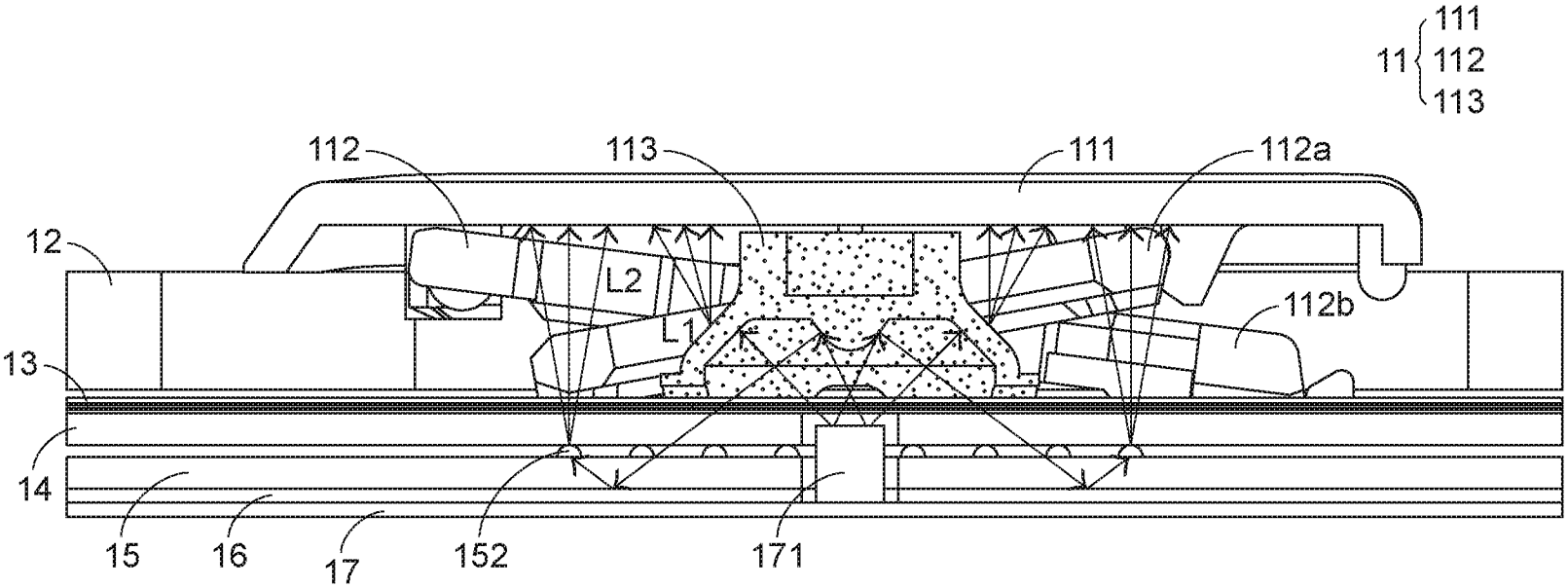
FIG. 4 is a schematic sectional diagram that only shows a single key of a luminous keyboard according to this application.

Refer to FIG. 1 to FIG. 4 together. FIG. 4 is a schematic sectional diagram that only shows a single key of a luminous keyboard according to this application. Each key 11 includes a key cap 111, a scissors foot mechanism 112, and a rubber dome 113. Both of the scissors foot mechanism 112 and the rubber dome 113 are located below the key cap 111, a pair of upper end portions 112*a* of the scissors foot mechanism 112 are pivotally connected to the key cap 111, a pair of lower end portions 112*b* of the scissors foot mechanism 112 pass through the thin-film circuit board 13 to be pivotally connected to the support plate 14. The rubber dome 113 pushes the key cap 111 upward. Preferably, a central accommodation space 1120 is formed in the scissors foot mechanism 112 to accommodate the rubber dome 113.

Further, the thin-film circuit board 13 is disposed below the key 11 and receives a press from a user on the key 11, to trigger the thin-film circuit board 13. The action thereof is that: the rubber dome 113 of the key 11 receives an external force applied by the user to the key cap 111 of the key 11, and the key cap 111 descends to deform the rubber dome 113 to trigger the thin-film circuit board 13 to generate an input signal. Because the thin-film circuit board 13 is made of a soft material and is thin, the support plate 14 is disposed below the thin-film circuit board 13, so as to bear the thin-film circuit board 13 by using the support plate 14. In addition, the support plate 14 includes a plurality of light-transmission through holes 140, for accommodating the plurality of light sources 171 (as shown in FIG. 3) or for transmission of the light ray.

On the other hand, the circuit board assembly 17 is the bottommost component of the entire luminous keyboard 1, the circuit board assembly 17 includes a printed circuit board 170 and light sources 171 electrically connected to the printed circuit board 170. Each key 11 corresponds to at least one light source 171, so that each key 11 receives a light ray emitted from the light source 171. Further, the reflector 16 is located above the printed circuit board 170 in an overlapping manner, and the reflector 16 includes a first opening 160, for the light ray emitted from the light source 171 to be emitted upward through the first opening 160. Similarly, the light guide plate 15 is located above the reflector 16 in an overlapping manner, and the light guide plate 15 includes a second opening 150, for the light ray emitted from the light source 171 to be emitted upward through the first opening 160 of the reflector 16 and the second opening 150 of the light guide plate 15. The light guide plate 15 includes an upper surface 151 and a plurality of light-diffusion protrusion 152 formed on the upper surface 151, and after passing through the light-diffusion protrusions 152, a light ray either in a downward direction or an upward direction would be diffused to make overall light emission more uniform.

In a preferred implementation, each key cap 111 includes at least one transparent pattern 1115, and a uniform light ray travels from bottom to top to pass through the at least transparent pattern 1115 to illuminate the outside.

When traveling upward, a light ray emitted by the light source 171 would be emitted to the rubber dome 113. A characteristic of the rubber dome 113 is that the rubber dome 113 is made of a translucent material doped with a plurality of light-diffusion particles. The light-diffusion particles are one of PMMA particles, $TiO_2$ particle, and toner particles. Therefore, a traveling path of the light ray is that: when the light ray is irradiated to the rubber dome 113, a part L1 of the light ray passes through the rubber dome 113 to be emitted upward, and when being emitted upward, the light ray is diffused by the doped light-diffusion particles, and the other part L2 of the light ray is reflected downward by the rubber dome 113, and then, is diffused by the plurality of light-diffusion protrusions 152. In other words, after the light ray emitted from the light source 171 sequentially passes through the light guide plate 15 (which can transmit light), through holes 140 of the support plate 14, and a hole 130 of the thin-film circuit board 13, a part L1 of the light ray passes through the rubber dome 113 and then, is emitted outward through the key cap 111, and the other part L2 of the light ray is reflected for a first time as being reflected downward by the rubber dome 113, then is reflected for a second time as being reflected outward by the reflector 16, is diffused by the light-diffusion protrusions 152 of the light guide plate 15, and finally, is emitted outward through the key cap 111. Preferably, the plurality of light-diffusion protrusions 152 surround the light sources 171. By means of such a setting, the other part L2 of the light ray that is reflected for a first time as being reflected downward by the rubber dome 113 is helped to pass by the light-diffusion protrusions 152, thereby producing a preferable light diffusion effect.

In a preferred implementation, the translucent material used for the rubber dome 113 has a reflection coefficient and a transmission coefficient, and a value of the reflection coefficient is greater than a value of the transmission coefficient. An objective of the above is designing that an amount of the reflected light ray is greater than an amount of the transmitted light ray, so as to reduce a proportion of the directly transmitted light ray, thereby preventing the light rays from being over centralized and dazzling.

Based on the above, in the luminous keyboard of this application, by changing the material of the rubber dome to the translucent material doped with the plurality of light-diffusion particles, a part of a light ray emitted to the rubber dome is diffused when being transmitted upward through the rubber dome, and the other part of the light ray emitted to the rubber dome is reflected downward to pass by the plurality of light diffusion protrusions of the light guide plate and be reflected outward by the reflector, so that the light ray is reflected and diffused, and it is not emitted in a centralized manner. Therefore, a designer may plan and adjust proportions of light ray transmission and light ray refection, so as to distribute and render uniform brightness on the surface of the entire luminous keyboard.

The foregoing embodiments merely illustratively describe the principles and effects of the present invention and explain technical features of the present invention instead of limiting the protection scope of the present invention. All the changes or equivalent arrangements that can be easily completed by a person skilled in the art without departing from the technical principles and spirit of the present invention fall within the scope claimed by the present invention.

Therefore, the protection scopes of the present invention are listed as the following claims.

What is claimed is:

1. A luminous keyboard, comprising:

a plurality of keys, each of the keys comprising:

a key cap;

a scissors foot mechanism, located below the key cap and pivotally connected to the key cap; and a rubber dome, disposed below the key cap and pushing the key cap upward, wherein the rubber dome is made of a translucent material doped with a plurality of light-diffusion particles, and when the rubber dome is irradiated by a light ray, a part of the light ray passes through the rubber dome, and the other part of the light ray is reflected by the rubber dome;

a thin-film circuit board, disposed below the rubber dome, wherein the rubber dome can receive an external force from the key cap to be deformed downward to trigger the thin-film circuit board to generate an input signal;

a support plate, located below the thin-film circuit board, wherein the scissors foot mechanism passes through the thin-film circuit board to be pivotally connected to the support plate, and the support plate comprises a plurality of light-transmission through holes;

a light guide plate, located below the support plate, wherein the light guide plate comprises an upper surface and a plurality of light-diffusion protrusions formed on the upper surface;

a reflector, located below the light guide plate; and a circuit board assembly, located below the reflector, wherein the circuit board assembly comprises a printed circuit board and a plurality of light sources electrically connected to the printed circuit board, and each of the keys corresponds to at least one of the light source, so that each of the keys receives the light ray emitted from the light source, wherein after the light ray sequentially passes through the light guide plate, the support plate, and the thin-film circuit board, the part of the light ray passes through the rubber dome and then, is emitted outward through the key cap, and the other part of the light ray is reflected for a first time as being reflected downward by the rubber dome, then is reflected for a second time as being reflected outward by the reflector, is diffused by the light-diffusion protrusions of the light guide plate, and finally, is emitted outward through the key cap.

2. The luminous keyboard according to claim 1, wherein the light-diffusion particles are one of polymethylmethacrylate (PMMA) particles, titanium dioxide ($TiO_2$) particles, and toner particles.

3. The luminous keyboard according to claim 1, wherein the translucent material has a reflection coefficient and a transmission coefficient, and a value of the reflection coefficient is greater than a value of the transmission coefficient, so that an amount of the reflected light ray is greater than an amount of the transmitted light ray.

4. The luminous keyboard according to claim 1, wherein the light-diffusion protrusions surrounds the light sources.

5. The luminous keyboard according to claim 1, wherein the key cap comprises at least one transparent pattern, and the light ray passes through the at least transparent pattern to illuminate the outside.

6. The luminous keyboard according to claim 1, further comprising an upper frame cover, wherein the upper frame covers the thin-film circuit board and exposes the keys.

* * * * *